US006033821A

United States Patent [19]

Hosoi et al.

[11] Patent Number: 6,033,821

[45] **Date of Patent: *Mar. 7, 2000**

[54] ELECTROPHOTOGRAPHIC TRANSFER SHEET AND METHOD FOR FORMING COLOR IMAGE

[75] Inventors: Kiyoshi Hosoi; Chizuru Kitaoka, both of Ebina; Masaru Kato; Tomofumi Tokiyoshi, both of Tokyo, all of Japan

[73] Assignees: Fuji Xerox Co., Ltd; Oji Paper Co., Ltd., both of Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/016,230

[22] Filed: Jan. 30, 1998

[30] Foreign Application Priority Data

Feb. 3, 1997 [JP] Japan ..... 9-020348

[51] Int. Cl.[7] ..... G03G 13/20

[52] U.S. Cl. ..... 430/124; 430/47; 430/111

[58] Field of Search ..... 428/195, 212; 430/47, 96, 126, 124, 111

[56] References Cited

U.S. PATENT DOCUMENTS 5,314,767 5/1994 Bussard ..... 430/1
5,378,576 1/1995 Sakai et al. ..... 430/126
5,663,021 9/1997 Hosoi et al. ..... 430/47

FOREIGN PATENT DOCUMENTS 63-92965 4/1988 Japan .
5-127413 5/1993 Japan .
5-216322 8/1993 Japan .
6-11982 1/1994 Japan .

*Primary Examiner*—Mark Chapman
*Attorney, Agent, or Firm*—Oliff & Berridge, PLC

[57] ABSTRACT

An electrophotographic transfer sheet which comprises a substrate having, on at least one side thereof, a transparent resin layer comprising a polyester resin as a main component, wherein the weight average molecular weight (Mwa) of the transparent resin and the weight average molecular weight (Mwb) of a binding resin of a color toner used for fixing satisfy the relationship represented by the following equation:

$$Mwa-Mwb \geqq 10{,}000$$

and a melt inclination angle between the transparent resin and the binding resin of the color toner at the fixing temperature of the color toner is 40° or less.

2 Claims, 6 Drawing Sheets

ELECTROPHOTOGRAPHIC TRANSFER SHEET AND METHOD FOR FORMING COLOR IMAGE

FIELD OF THE INVENTION

The present invention relates to an electrophotographic transfer sheet for use as a material onto which a toner image is transferred by using an indirect dry type full color electrophotographic copier or printer. The present invention also relates to a method for forming a color image on the above-described transfer sheet using a color toner by fixing with application of pressure and heat.

BACKGROUND OF THE INVENTION

With the progress in colorization and digitization of an electrophotographic copier and printer, the improvement of the image quality of electrophotographic has hitherto been discussed. In particular, in an electrophotographic full color copier and printer, digitization of input/output of images has been advanced for obtaining an image of high image quality, and an inputting method of images, a processing method of inputted images, a developing method, a transferring method, a fixing method, etc., have been largely improved. Further, a developer and an image-forming material of a photoreceptor have been improved correspondingly to high digital precision and color recording of highly developed color.

However, since toners having a particle size of from several micrometers to several ten micrometers are used in an electrophotographic full color copier and printer, if a plain paper or a coated paper is used as an image support, toners expand slightly above the level irregularly between high density areas and low density areas. As a result, the unevenness of the gloss of the surface is generated and there arises a problem such that the image quality thus obtained is inferior to those of a photographic image and a printed image.

In order to improve such a problem, JP-A-63-92965 (the term "JP-A" as used herein means an "unexamined published Japanese patent application") proposes a technique which comprises providing, on an image support, a transparent resin layer having a thickness thicker than a certain value, the softening point of a transparent resin used in the transparent resin layer being lower than that of the toner, and embeding a toner image in the transparent resin layer using a roller type fixing apparatus.

Moreover, JP-A-5-127413 discloses a method, for the same purpose as the above method, which comprises overlaying a toner image on an image support having a transparent resin layer comprising a crosslinked resin which has a glass transition temperature within a specific range and is soluble in a tetrahydrofuran, and embeding the toner image into the transparent resin layer using a belt type fixing apparatus.

Still further, JP-A-5-216322 and JP-A-6-11982 disclose a method similar to the latter method, which comprises providing a transparent resin layer comprising a thermoplastic resin having a certain thickness on an image support, transferring and adhering a toner thereon, and embeding the toner image into the transparent resin layer using a belt type fixing apparatus.

However, in JP-A-63-92965, since the softening point of the transparent resin is lower than that of the toner, the transparent resin becomes soft faster than the toner and becomes liable to flow upon application of heat and pressure using a fixing apparatus. As a result, troubles arise such that the image area is dimpled like a shell pattern to vanish the surface gloss, that the transparent resin layer is taken away by the fixing apparatus, thereby the image is lost, and that the transfer sheet per se adheres to the fixing apparatus (hereinafter this phenomenon is called an offset phenomenon). Further, since the transparent resin is soft and the layer thickness is thick, the toner is liable to permeate the layer in a granular state and colors are not developed sufficiently or the toner does not mix with each other. Therefore, the original colors cannot be reproduced faithfully. That is, color reproducibility is reduced.

There are disclosed in JP-A-5-127413, JP-A-5-216322 and JP-A-6-11982 that according to these methods described therein the above-described offset phenomenon hardly occurs due to the employment of a belt type fixing apparatus. However, since the thickness of the transparent resin layer is thick, e.g., from 20 to 200 $\mu$m, the compatibility with the toner is not taken into consideration, the toner is liable to get into the image-receiving layer as it is without sufficiently melting. As a result, particularly in the secondary color part, there is a possibility that sufficient color mixture does not occur and reproduced colors differ from the original colors. Thus, color reproducibility is deteriorated.

SUMMARY OF THE INVENTION

The present invention has been made for solving the above-described problems.

Accordingly, an object of the present invention is to provide an electrophotographic transfer sheet which provides uniform surface gloss of an image and excellent color reproducibility and which causes no offset phenomenon.

Another object of the present invention is to provide an image forming method using the electrophotographic transfer sheet.

The above described objective of the present invention has been attained by employing the following constitution.

(1) An electrophotographic transfer sheet which comprises a substrate having, on at least one side thereof, a transparent resin layer comprising a polyester resin as a main component, wherein the weight average molecular weight (Mwa) of the transparent resin and the weight average molecular weight (Mwb) of a binding resin contained in a color toner used for fixing satisfy the relationship represented by the following equation:

$$Mwa-Mwb \geqq 10{,}000$$

and a melt inclination angle between the transparent resin with the binding resin of the color toner at the fixing temperature of the color toner is 40° or less.

(2) An electrophotographic transfer sheet which comprises a substrate having, on at least one side thereof, a transparent resin layer comprising a polyester resin as a main component, wherein the ratio (Mwa/Mna) of the weight average molecular weight (Mwa) to the number average molecular weight (Mna) of the transparent resin and the ratio (Mwb/Mnb) of the weight average molecular weight (Mwb) to the number average molecular weight (Mnb) of a binding resin of a color toner to be fixed satisfy the relationship represented by the following equation:

$$(Mwa/Mna)-(Mwb/Mnb) \geqq 2.0$$

and a melt inclination angle between the transparent resin with the binding resin of the color toner at the fixing temperature of the color toner is 40° or less.

(3) The electrophotographic transfer sheet as described in the above (1) or (2), wherein the substrate has a basis weight of from 70 to 200 g/m$^2$ (as measured according to JIS P8124).

(4) The electrophotographic transfer sheet as described in the above (1), (2) or (3), wherein the coating weight of the transparent resin layer is from 2 to 15 g/m$^2$.

(5) A method for forming a color image which comprises the steps of:

developing using a color toner comprising a polyester binding resin to form a color toner image; and heat-fixing the color toner image onto any one of the electrophotographic transfer sheets according to the above (1) to (4).

DETAILED DESCRIPTION OF THE INVENTION

Figure 1:
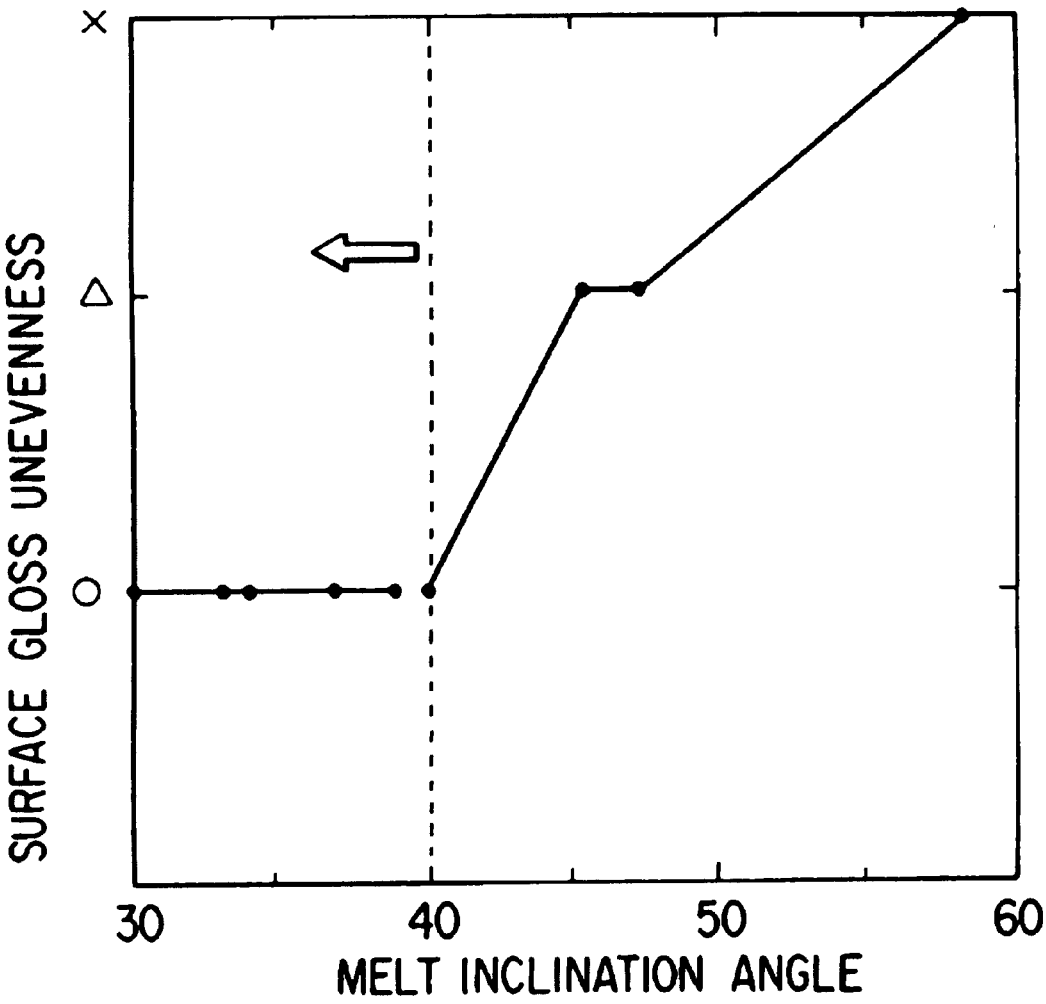
FIG. 1 is a graph showing the relationship between the melt inclination angle of the transparent resin with respect to the toner binding resin and the surface gloss unevenness.

As a result of extensive study to provide an electrophotographic transfer sheet which is improved in image gloss unevenness, color reproducibility and the offset phenomenon, the present inventors have obtained findings in particular from the investigations performed by paying attention to the characteristics of the resin for use in a transparent resin layer. That is, the present inventors have found that (i) the relationship between the weight average molecular weight of the binding resin of the color toner to be fixed and the weight average molecular weight of the transparent resin of the transfer sheet, (ii) the relationship between the ratio of the weight average molecular weight to the number average molecular weight of the color toner to be fixed and the ratio of the weight average molecular weight to the number average molecular weight of the transparent resin, and (iii) the compatibility of the transparent resin with the toner binding resin are largely related to the above problems. The present invention has been accomplished based on such findings.

That is, in order to improve gloss unevenness of the image surface and the color reproducibility, it is important to make the unevenness of the color toner image on the transparent resin layer surface of the transfer sheet small and the color toner sufficiently fused with the transparent resin layer. Accordingly, it is important that the transparent resin layer softens at the melting point of the toner binding resin and the compatibility of the toner binding resin with the transparent resin is heightened, i.e., the melt inclination angle between the toner binding resin and the transparent resin is made small.

It was further found that it is important for the transparent resin not to be too soft at the melting point of the toner binding resin for improving the offset phenomenon.

Thus, in general, the improvement of the surface gloss unevenness and color reproducibility by making the color toner image unevenness small on the transparent resin layer surface of the transfer sheet and the improvement of the offset phenomenon have been thought to be incompatible and these cannot be improved at the same time.

However, from the investigations performed by paying attention to the relationship between the weight average molecular weights of the toner binding resin to be fixed and the transparent resin of the transfer sheet and the melt inclination angle between the color toner binding resin and the transparent resin, it was found that the generation of the offset phenomenon can be prevented by making the weight average molecular weight of the transparent resin larger than that of the toner binding resin by a specific value, and the compatibility of the color toner binding resin with the transparent resin can be improved by selecting a transparent resin having a small melt inclination angle with respect to the color toner binding resin. As a result, the toner does not granulate in the image-receiving layer and permeate the layer in the vertical direction to the surface of the sheet in a sufficiently melted state, accordingly, color reproducibility and color toner image unevenness are improved and a image quality without uneven surface gloss can be provided.

FIG. 1 is a graph showing the relationship between the melt inclination angle of the transparent resin with respect to the toner binding resin and the surface gloss unevenness obtained by examining gloss unevenness by selecting the kinds of toner binding resins and transparent resins and varying the melt inclination angle. As is apparently seen from FIG. 1, for the improvement of the surface gloss unevenness, it is necessary to make the melt inclination angle small. The gloss unevenness could be solved with the melt inclination angle of 40° or less.

Figure 2:
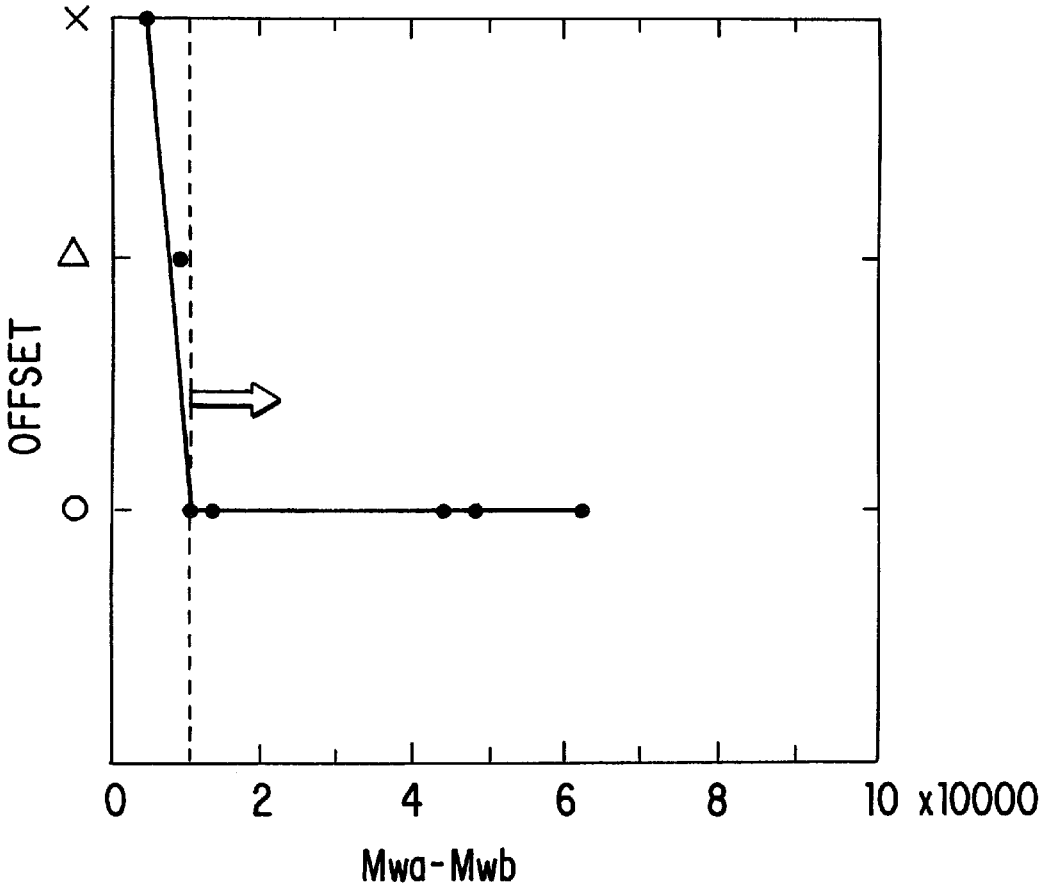
FIG. 2 is a graph showing the relationship between the offset phenomenon and the difference between the weight average molecular weight of the phenomenon resin and that of the toner binding resin.

FIG. 2 is a graph showing the relationship between the offset phenomenon and the difference between the weight average molecular weight of the phenomenon resin (Mwa) and that of the toner binding resin (Mwb) obtained by examining the state of occurrence of the offset phenomenon by varying the above difference. As is apparent from FIG. 2, for the improvement of the offset phenomenon, the above difference is necessary to be 10,000 or more.

Thus, the present inventors have found that the improvement of the surface gloss unevenness can be consistent with the improvement of the offset phenomenon with the transparent resin having the weight average molecular weight bigger than that of the toner binding resin by 10,000 or more, and with the melt inclination angle of 40° or less, as is shown in FIG. 2.

Figure 3:
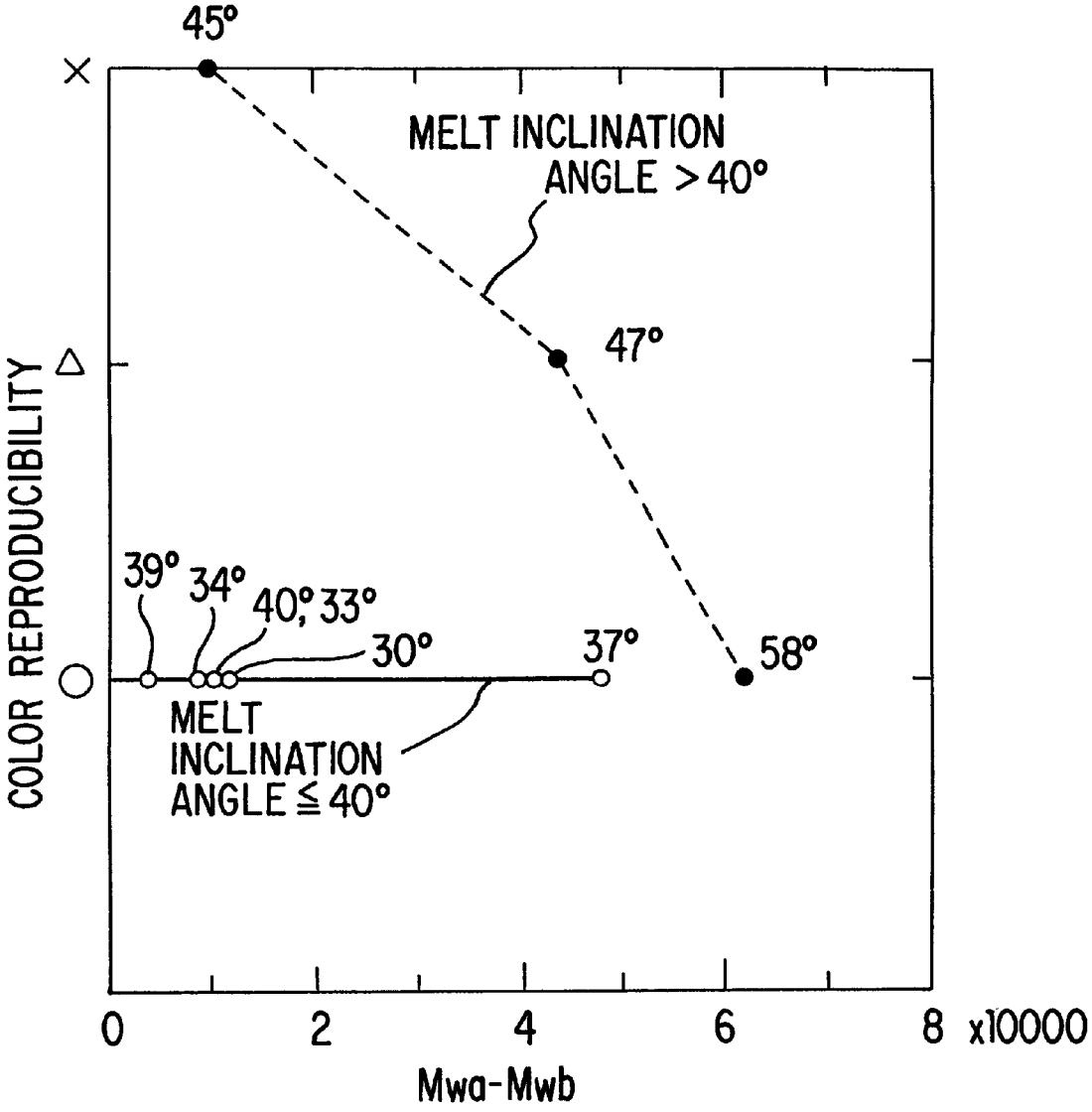
FIG. 3 is a graph showing the relationship between the color reproducibility and the difference between the weight average molecular weight of the transparent resin and that of the toner binding resin and the melt inclination angle.

FIG. 3 is a graph showing the relationship between the color reproducibility and the difference between the weight average molecular weight of the transparent resin (Mwa) and that of the toner binding resin (Mwb) obtained by examining the color reproducibility by varying the above difference. As is apparent from FIG. 3, when the transparent resin having the melt inclination angle with respect to the toner binding resin of larger than 40°, that is, having worse compatibility, is used, the nearer the weight average molecular weight to that of the toner binding resin (the smaller the above difference (Mwa−Mwb)), the worse is the color reproducibility. Accordingly, it was found that the color reproducibility can be improved by selecting resins having the melt inclination angle with respect to the toner binding resin of 40° or less.

That is, it was found, in order to improve the surface gloss unevenness and the color reproducibility, that the weight average molecular weight (Mwa) of the transparent resin and the weight average molecular weight (Mwb) of the color toner binding resin used for fixing have the relationship represented by the following equation:

$$Mwa-Mwb \geqq 10{,}000$$

and a melt inclination angle of the transparent resin with respect to the binding resin of the color toner is 40° or less.

Figure 4:
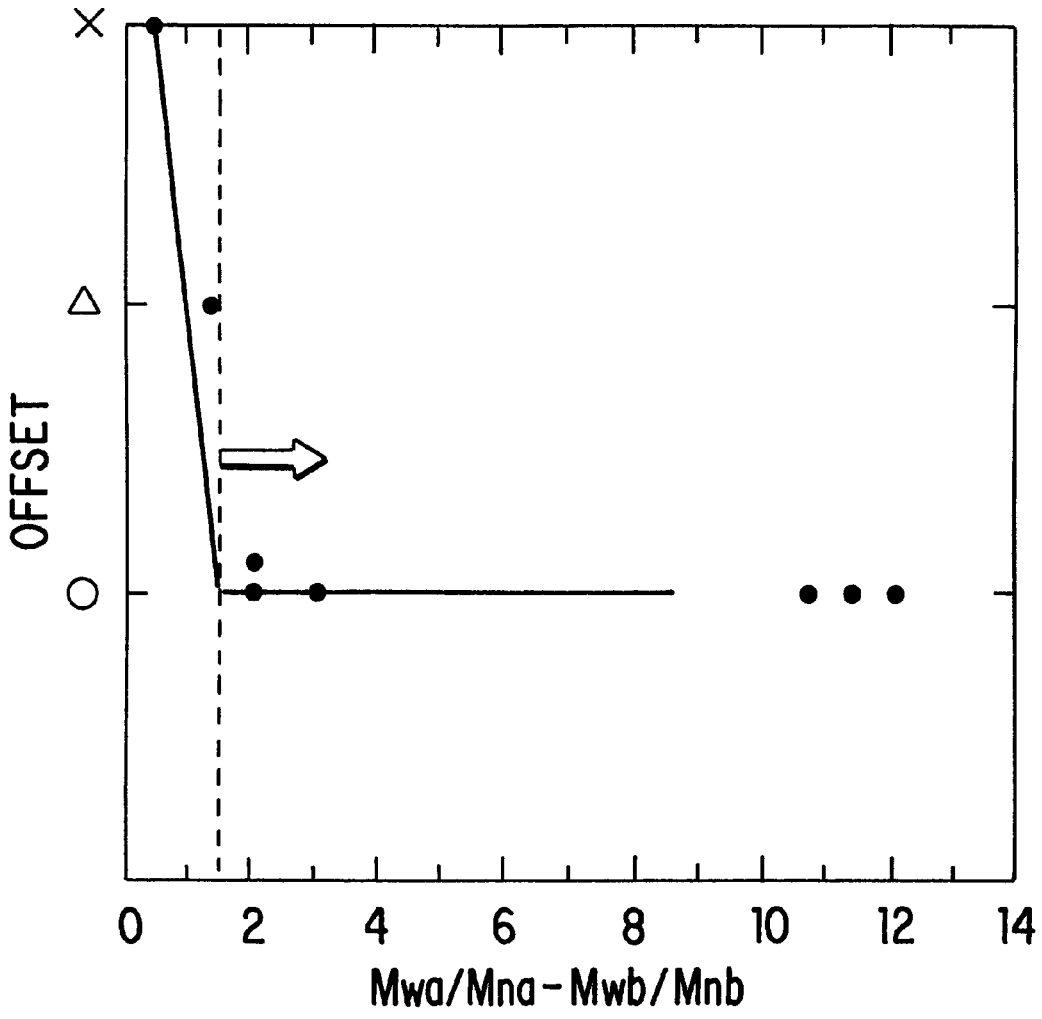
FIG. 4 is a graph showing the relationship between the offset phenomenon and the difference between the ratio (Mwa/Mna) of the weight average molecular weight to the number average molecular weight of the phenomenon resin and the ratio (Mwb/Mnb) of the weight average molecular weight to the number average molecular weight of the color toner, i.e., (Mwa/Mna)−(Mwb/Mnb).
Figure 5:
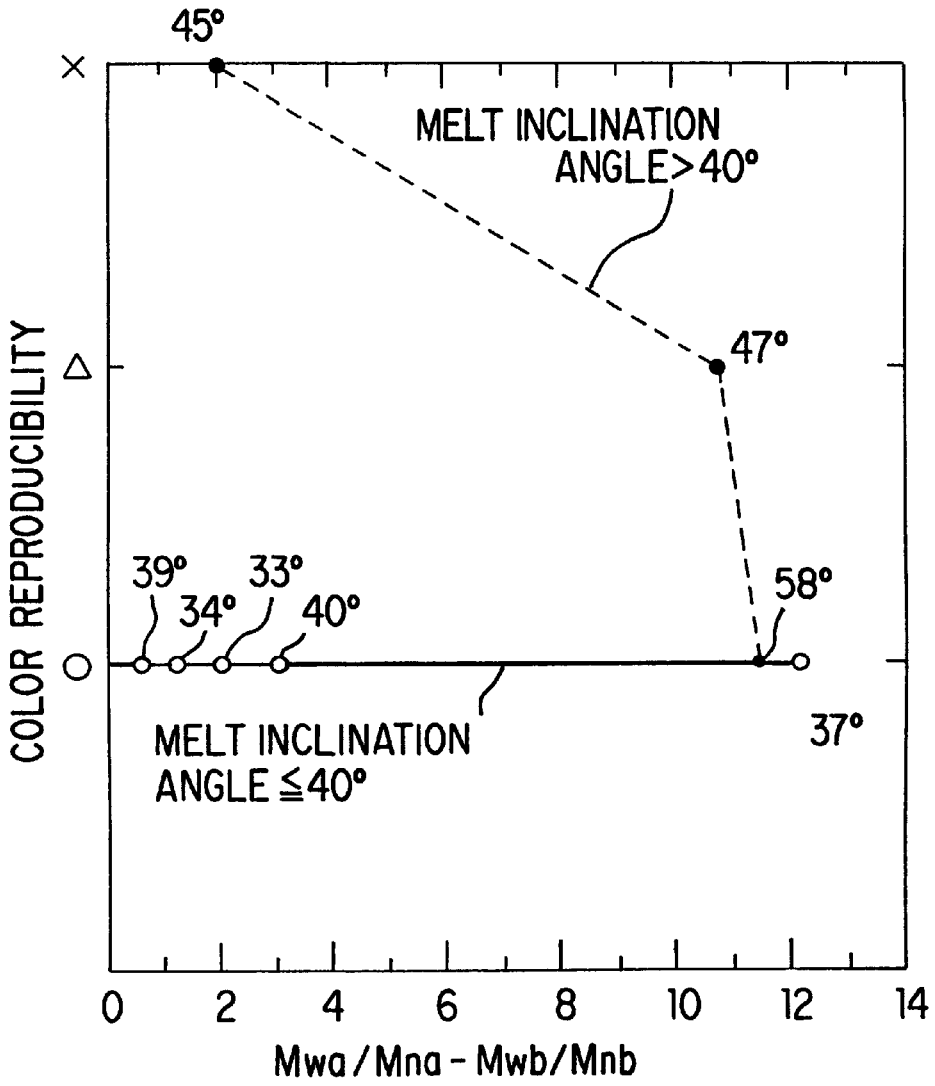
FIG. 5 is a graph showing the relationship between the color reproducibility and the difference between the ratio (Mwa/Mna) of the weight average molecular weight to the number average molecular weight of the transparent resin and the ratio (Mwb/Mnb) of the weight average molecular weight to the number average molecular weight of the color toner, i.e., (Mwa/Mna)−(Mwb/Mnb).

FIG. 4 is a graph showing the relationship between the offset phenomenon and the difference between the ratio (Mwa/Mna) of the weight average molecular weight (Mwa) to the number average molecular weight (Mna) of the transparent resin and the ratio (Mwb/Mnb) of the weight average molecular weight (Mwb) to the number average molecular weight (Mnb) of the color toner, i.e., (Mwa/Mna)−(Mwb/Mnb), obtained by examining the occurrence of the offset phenomenon by varying the above difference (in FIG. 4, criteria of symbols ○, Δ and x are the same as in FIG. 2). FIG. 5 is a graph showing the relationship between the above difference and the color reproducibility obtained by examining the color reproducibility by varying the above difference (in FIG. 5, criteria of symbols ○, Δ and × are the same as in FIG. 3).

As is apparent from FIGS. 4 and 5, when the ratio (Mwa/Mna) of the weight average molecular weight (Mwa) to the number average molecular weight (Mna) of the transparent resin and the ratio (Mwb/Mnb) of the weight average molecular weight (Mwb) to the number average molecular weight (Mnb) of the color toner binding resin to be fixed satisfy the relationship represented by the following equation, the above-described offset and the color reproducibility can be improved:

$$(Mwa/Mna)-(Mwb/Mnb) \geqq 2.0$$

The weight average molecular weight and the number average molecular weight of the transparent resin and the toner binding resin were respectively determined as follows. Determination was conducted by flowing a solvent (tetrahydrofuran) at a rate of 1 ml/min., pouring 5 mg of a tetrahydrofuran sample solution having a concentration of 1.0 g/20 ml, using gel permeation chromatography (GPC) HLC-802A (produced by Toso Co.) as a measuring apparatus, GMH6 as a column, while maintaining the column temperature at 40° C. A polystyrene standard sample was used as a standard sample. In determination of the molecular weight of the sample, determination condition was selected such that the molecular weight of the determined sample would fall within the range of the straight line made by the molecular weight on the analytical curve formed by several kinds of monodisperse polystyrene standard samples and the counted value.

As a method of correctly evaluating the compatibility of the transparent resin and the toner binding resin, the present inventors have found a novel criterion. The method of determination of the melt inclination angle is as described below.

Measuring Method of Melt Inclination Angle (1) Preparation of a toner binding resin A toner-forming resin is ground in a mortar to prepare five pellets of resins having a diameter of from 2 to 3 mm.

(2) Melt fixation of the toner binding resin

Figure 8:
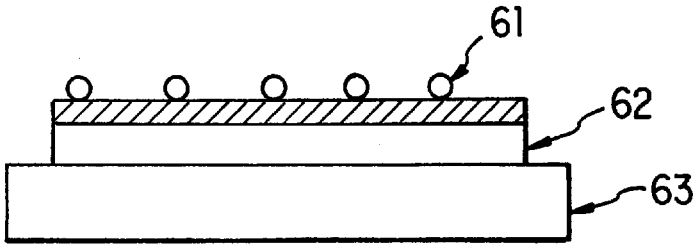
FIG. 8 is a schematic cross-sectional view of the melt fixation apparatus of the toner disc used for measuring the melt inclination angle.

As shown in FIG. 8, onto hot plate 63 which is set at the fixing temperature of the toner, there are put transfer sheet 62, with the transparent resin thereof being upside, and binding resin particles 61. The binding resin is melted by hot plate 63 over 90 seconds, then cooled and solidified.

(3) Measurement of melt inclination angle

After the toner binding resin is solidified, the bottom angle of the toner binding resin particle is determined two times each of left and right sides per one particle using a contact angle measuring apparatus CA-X type, a product of Kyowa Kaimen Kagaku Co., Ltd. The average of results obtained 10-time measurements is taken as a melt inclination angle.

The electrophotographic transfer sheet of the present invention comprises a substrate having, on at least one side thereof, a transparent resin layer comprising a polyester resin, and the weight average molecular weight (Mwa) of the transparent resin and the weight average molecular weight (Mwb) of the color toner binding resin used for fixing, each determined by gel permeation chromatography, satisfy the relationship represented by the following equation:

$$Mwa-Mwb \geqq 10{,}000$$

and a melt inclination angle of the transparent resin with respect to the color toner binding resin at the fixing temperature of the color toner is adjusted to 40° or less. This transfer sheet is particularly excellent in image quality as an electrophotographic color image sheet and has resistance against the offset phenomenon.

The electrophotographic transfer sheet of the present invention comprises a substrate having provided on at least one side thereof a transparent resin layer comprising a polyester resin, and the ratio (Mwa/Mna) of the weight average molecular weight (Mwa) to the number average molecular weight (Mna) of the transparent resin and the ratio (Mwb/Mnb) of the weight average molecular weight (Mwb) to the number average molecular weight (Mnb) of the color toner binding resin to be fixed satisfy the relationship represented by the following equation:

$$(Mwa/Mna)-(Mwb/Mnb) \geqq 2.0$$

and a melt inclination angle of the transparent resin with respect to the color toner binding resin at the fixing temperature of the color toner is 40° or less. This transfer sheet is particularly excellent in image quality as an electrophotographic color image sheet and has resistance against the offset phenomenon.

Figure 6:
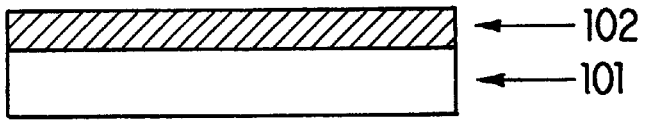
FIG. 6 is a cross-sectional view of the electrophotographic transfer sheet comprising a substrate having, on one side thereof, a transparent resin layer of the present invention.
Figure 7:
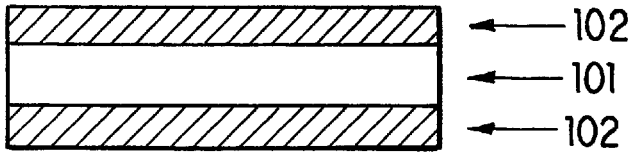
FIG. 7 is a cross-sectional view of the electrophotographic transfer sheet comprising a substrate having provided on both sides thereof transparent resin layers of the present invention.

The cross-sectional view of the electrophotographic transfer sheet of the present invention is described below with referring to FIG. 6 and FIG. 7. In the figures, 101 is a substrate and 102 is a transparent resin layer. FIG. 6 is a view of the electrophotographic transfer sheet comprising a substrate having provided on one side thereof a transparent resin layer, and FIG. 7 is a view of the electrophotographic transfer sheet comprising a substrate having provided on both sides thereof transparent resin layers.

The substrate for use in the electrophotographic transfer sheet of the present invention is selected according to purposes, and examples thereof include, e.g., a plain paper, a coat paper for printing, an art paper, a cast coated paper, etc., but the substrate is not limited to these examples and a synthetic paper and a plastic film can also be used. The substrate preferably has a basis weight (as measured according to JIS P8124) of from 70 to 200 g/m$^2$, particularly preferably from 100 to 180 g/m$^2$. If the basis weight is less than 70 g/m$^2$, the strength of the transfer sheet lowers, and liable to wind around the roll in a roll type fixing apparatus, or curling after toner fixation is liable to become large. While when the basis weight is more than 200 g/m$^2$, as heat capacity to embed the toner in the image-receiving layer becomes short, gloss unevenness occurs.

Examples of polyester resins for forming a transparent resin layer which can be used in the present invention include polyester resins comprising, as monomers, ethylene oxide adduct of bisphenol A/propylene oxide adduct of bisphenol A/terephthalic acid/glycerol, polyester resins comprising propylene oxide adduct of bisphenol A/fumaric acid, polyester resins comprising ethylene oxide adduct of bisphenol A/dodecynyl succinic acid/terephthalic acid, polyester resins comprising ethylene glycol adduct of bisphenol A/fumaric acid/isopropylene glycol, etc., but examples are not limited thereto.

However, when a electrophotographic resin is selected in view of the melt inclination angle, polyester resins having the melt inclination angle of the toner binding resin used for forming a color image with respect to the transparent resin of the transfer sheet of 40° or less should be used.

If the melt inclination angle of the toner binding resin with respect to the transparent resin is more than 40°, the compatibility of the transparent resin with the toner lowers, and the toner is difficult to be buried in the transparent resin layer, as a result, unevenness of the surface is generated leading to the gloss unevenness. Further, when the melt inclination angle of the toner binding resin with respect to the transparent resin is more than 40°, and the ratio (Mwa/Mna) of the weight average molecular weight to the number average molecular weight of the transparent resin and the same ratio of the color toner (Mwb/Mnb) satisfy the following relationship, although the toner is buried in the transparent layer, as the toner is buried in a granular state not sufficiently fused with the transparent resin, the developed colors differ from the original colors, and the image having not good color reproducibility is disadvantageously formed.

The weight average molecular weight (Mwa) of the polyester resin and the weight average molecular weight (Mwb) of the color toner binding resin to be fixed, each determined by GPC, have the relationship satisfying the following equation:

$$Mwa-Mwb \geqq 10{,}000;$$

and preferably $$Mwa-Mwb \geqq 12{,}000.$$

If the weight average molecular weight of the polyester resin is larger than the weight average molecular weight of the toner binding resin to be fixed by less than 10,000, as the polyester resin is liable to soften more than the toner binding resin does at the toner fixing temperature, the offset is disadvantageously liable to occur.

The ratio (Mwa/Mna) of the weight average molecular weight (Mwa) to the number average molecular weight (Mna) of the polyester resin and the ratio (Mwb/Mnb) of the weight average molecular weight (Mwb) to the number average molecular weight (Mnb) of the color toner binding resin to be fixed have the relationship satisfying the following equation:

$$(Mwa/Mna)-(Mwb/Mnb) \geqq 2.0;$$

and preferably $$(Mwa/Mna)-(Mwb/Mnb) \geqq 2.5$$

If the ratio (Mwa/Mna) of the weight average molecular weight (Mwa) to the number average molecular weight (Mna) of the polyester resin is larger than the ratio (Mwb/Mnb) of the weight average molecular weight (Mwb) to the number average molecular weight (Mnb) of the color toner binding resin to be fixed by less than 2.0, as the polyester resin is liable to soften more than the toner binding resin does at the toner fixing temperature, the offset phenomenon is disadvantageously liable to occur.

The coating weight of the transparent resin layer is from 2 to 15 g/m$^2$, preferably from 3 to 8 g/m$^2$. If the coating weight of the transparent resin layer is less than 2 g/m$^2$, the color toner cannot be certainly buried into the transparent resin layer, as a result, the unevenness of the toner is generated leading to unadvantageous irregularity of the gloss. While when the coating weight of the transparent resin layer is more than 15 g/m$^2$, the layer is peeled off in the image-receiving layer during fixing, as a result, the unadvantageous offset phenomenon is liable to occur.

A forming method of the electrophotographic transfer sheet according to the present invention is described below.

a polyester resin for use in the present invention is dissolved in a mixed organic solvent comprising one or more of alcohols, e.g., methanol, ethanol, etc., ketones, e.g., acetone, methyl ethyl ketone, etc., and chlorinated hydrocarbons, e.g., methylene chloride, ethylene chloride, tetrachloroethane, etc., or ethyl acetate or tetrahydrofuran, coated on a substrate by a coating method, e.g., a bar coated method, a dip coating method, a spray coating method, a roll coating method, and dried.

Further, a matting agent, a lubricant and/or an antistatic agent can be contained in the transparent resin layer for adjusting friction coefficient between sheets, if necessary.

Examples of matting agents which can be used include fine particles such as silica, starch, alumina, etc., and plastic powders such as polyethylene, polyester, polyacrylonitrile, polymethyl methacrylate, etc. The amount of the matting agent is preferably from 0.1 to 10 wt % based on the amount of the resin used. The matting agent preferably has an average particle size of 7 $\mu$m or less. The particle size and the amount used of the matting agent are adjusted such that the surface gloss of the transparent resin layer (measured according to JIS P8124) reaches 85% or more.

Examples of lubricants include a higher fatty acid such as a stearic acid, a higher fatty acid metal salt such as a zinc stearate, a higher fatty acid amide such as a stearic acid amide, methylol compounds thereof, and a hydrocarbon such as a polyethylene wax. The lubricant preferably has a particle size of 8 μm or less.

Examples of antistatic agents which can be used in the present invention include alkylbenzimidazole sulfonate, naphthalene sulfonate, carboxylic acid sulfonate, phosphate, heterocyclic amines, ammonium salts, sulfonium salts, phosphonium slats, betaine-based amphoteric salts, and metal oxides, e.g., ZnO, $SnO_2$, $Al_2O_3$, $In_2O_3$, MgO, BaO, $MoO_3$, $TiO_2$, etc. The amount to be used of the above organic antistatic agents is from 0.1 to 10 wt %, and the amount of the above metal oxide antistatic agents is from 0.05 to 10 wt %, based on the amount of the transparent resin, respectively.

Toners for use in color image formation is described below.

Since it is necessary for toners for use in an indirect dry type full color electrophotographic apparatus to have good solubility and mixing capability during heating, sharp melt toners are preferably used. In view of the compatibility with the transparent resins, toners can be selected from among the same polyester resins as the transparent resin, and polyester resins composed of propylene oxide adduct of bisphenol A/fumaric acid.

The color toner of the present invention can be produced by melt kneading toner-forming materials such as a binding resin comprising a polyester resin, a coloring agent (e.g., a dye, a pigment), a charge-controlling agent, etc., pulverizing and classifying.

A method for forming a color image is described below.

Figure 9:
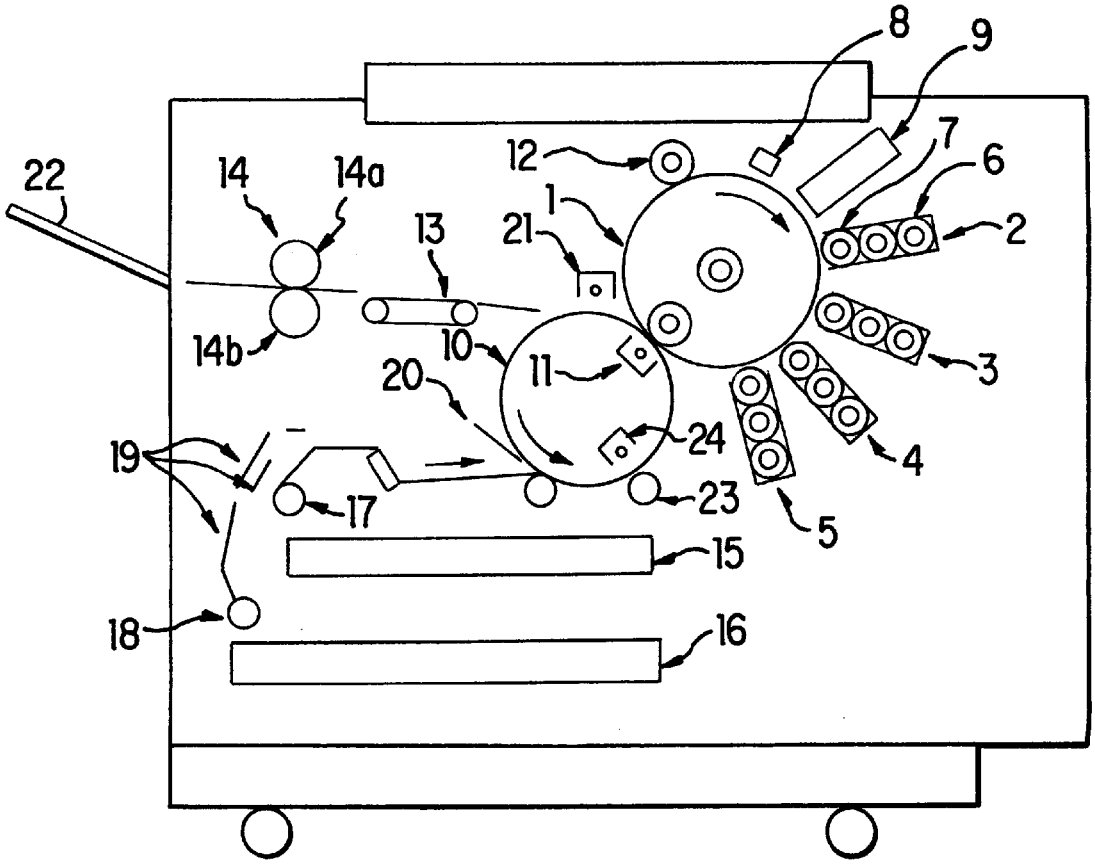
FIG. 9 is a schematic cross-sectional view of the indirect electrophotographic apparatus for forming a color image on the electrophotographic transfer sheet of the present invention.

FIG. 9 is a schematic cross-sectional view showing the electrophotographic apparatus of an example for forming a full color image for use in the present invention. The electrophotographic apparatus is divided broadly into the transfer sheet transporting system provided from the bottom to nearly the central part of the apparatus body, the latent image forming part installed at nearly the central part of the apparatus body in close vicinity to transferring drum 10, and the developing part disposed in close vicinity to the latent image forming part.

The transfer sheet transporting system is deposited with feeding trays 15 and 16 arranged at the lower part of the body, feeding rollers 17 and 18 arranged almost immediately upper part of each tray, paper-feeding guides 19 and 20 arranged in the vicinity of feeding rollers, and charging unit 21 for separation of transfer sheet in the vicinity of the peripheral surface. Transferring unit 11, electrode 24 are deposited in the inside of transferring drum 10, and contacting roller 23 is deposited on the outside so as to contact with the surface of transferring drum 10, and transferring drum 10 is rotated in the direction of the arrow. Further, transporting apparatus 13 is disposed with fixing apparatus 14 at the terminal side of the transporting direction. Discharge tray 22 is installed removably.

The latent image forming part is disposed with the peripheral surface of which being in contact with the peripheral surface of transferring drum 10, and comprises electrostatic latent image retainer (photoreceptor drum) 1 freely rotatable in the direction of the arrow, charging unit 8 arranged in the vicinity of the peripheral surface of the electrostatic latent image retainer, an image exposure means for forming an electrostatic latent image, e.g., a laser beam scanner, on the peripheral surface of the electrostatic latent image retainer, writing unit 9 having an image exposure reflection means, e.g., a polygonal mirror, and cleaning unit 12.

The developing part consists of developer holding member 7 and housing 6, and contains developing unit for black color 2, developing unit for magenta color 3, developing unit for cyan color 4, and developing unit for yellow color 5 for visualizing (i.e., developing) the electrostatic latent image formed on the peripheral surface of the electrostatic latent image retainer at the confronting position of electrostatic latent image retainer 1.

The sequence of image formation by the electrophotographic apparatus comprising the above structure is described taking the case of a full color mode as an example. When the above electrostatic latent image retainer 1 rotates in the arrow direction, the surface of the electrostatic latent image retainer is evenly charged by charging unit 8. When even charging is performed by charging unit 8, an electrostatic latent image is formed on electrostatic latent image retainer 1 by a laser beam modulated by a black image signal of the original (not shown in the figure) through writing unit 9, and the above electrostatic latent image is developed by developing unit for black color 2.

On the other hand, the transfer sheet transported from feeding tray 15 or 16 via feeding roller 17 or 18, and paper-feeding guide 19 or 20 is wound around transferring drum 10 electrostatically by electrode 24 disposed at the confronting position of contacting roller 23. Transferring drum 10 is rotating in the arrow direction synchronizing with electrostatic latent image retainer 1, the image developed by developing unit for black color 2 is transferred by transferring unit 11 at the part where the peripheral surface of electrostatic latent image retainer 1 and the peripheral surface of transferring drum 10 are connected. Transferring drum 10 continues rotation and stands by use for the transferring of the next color (in FIG. 9, magenta).

Electric charge of electrostatic latent image retainer 1 is removed by a charging unit for discharging (not shown in the figure), cleaned by cleaning unit 12, then charged again by charging unit 8, and receives the latent image light of the next magenta image signal as described above. Electrostatic latent image formed by image exposure from the magenta image signal is developed by developing unit for magenta color 3 to form a developed image. Subsequently, the procedure as above is repeated with cyan color and yellow color to complete the transfer of four colors. The thus-obtained multicolor developed image is, after charging is removed therefrom by charging unit 21, transported to fixing apparatus 14 by transporting apparatus 13, fixed by heat and pressure to complete a series of image formation sequence.

The main part of fixing apparatus 14 composed of heat roll 14*a* and pressure roll 14*b* each having a similar structure. Heat roll 14*a* is provided with a 500 W Coltz lamp in the inside of the roll, and consists of a substrate roll formed by a steel core material having the outer diameter of 44 mm, and a fluororubber (e.g., Biton rubber, produced by Du Pont) provided on the above substrate roll via a primer arbitrarily having the rubber hardness of JIS hardness 60° and the thickness of 40 μm. On the other hand, pressure roll 14*b* has the similar structure, except that the steel core material of the substrate roll has the outer diameter of 48 mm and the inner elastic layer comprising a silicone rubber having a thickness of 1 mm is provided on the substrate roll.

The above heat roll is provided, for modifying the above fluororubber surface to highly mold-releasing surface, with an oil donor roll comprising a silicone rubber as a mold lubricant-supplying means supplying a mold lubricant comprising dimethylpolysiloxane containing a functional group (e.g., an amino group). This oil donor roll is further supplied with a mold lubricant from the oil pick-up roll immersed in an oil pan.

The above heat roll 14*a* and pressure roll 14*b* are pressure-contacted with a pressure mechanism and 6 mm of a nip width is formed at the central part. The surface temperature of both rolls are set at 150° C., and they are respectively constructed so as to rotate in the direction of the arrow at the surface velocity of 60 mm/sec.

EXAMPLE 1

An electrophotographic transfer sheet was prepared. A polyester resin (ethylene oxide adduct of bisphenol A/propylene oxide adduct of bisphenol A/terephthalic acid/glycerol) having the weight average molecular weight of 23,000 and the ratio of the weight average molecular weight to the number average molecular weight of 5.9 determined by GPC was added to ethyl acetate in an amount of 20 wt % based on the ethyl acetate, alkyl phosphate surfactant was added thereto in an amount of 0.5 wt % based on the polyester resin as an antistatic agent, and the solution dissolved was coated by a bar coating method on the coat surface of a cast coated paper having a basis weight of 127.9 g/m$^2$ (a product of Oji Paper Co., Ltd.) so as to obtain the dry coat weight of the transparent resin layer of 5 g/m$^2$.

On the other hand, to 96 weight parts of a polyester resin (propylene oxide adduct of bisphenol A/fumaric acid) having the weight average molecular weight of 11,000 and the ratio of the weight average molecular weight to the number average molecular weight of 5.9 determined by GPC were added 1 weight part of a charge-controlling agent, 3 weight parts of a magenta pigment to prepare a magenta toner, or 3 weight parts of a yellow pigment to prepare a yellow toner, or 3 weight parts of a black pigment to prepare a black toner. The volume average particle size of these cyan, magenta, yellow and black toners was 7 $\mu$m.

The volume average particle size of the toner was obtained by determining the particle size distribution of particles having a particle size of from 2 to 50 $\mu$m using an aperture of 100 $\mu$m by a coulter counter TA-II type (a product of Coulter Co.).

The melt inclination angle of the toner binding resin with respect to the transparent resin determined using the above toner binding resins was 30°.

Using the above-obtained electrophotographic transfer sheet and color toners, picture-making was conducted using the electrophotographic apparatus shown in FIG. 6. The conditions of picture-making were as follows: The electrophotographic apparatus was modified such that the amount of the black toner corresponding to the part of the inputted dot area factor of 100% on the transfer film was 1.0 mg/cm$^2$, and each amount of yellow, magenta and cyan toners was 0.65 mg/cm$^2$. Charts used for evaluation of picture-making were the first colors of yellow, magenta and cyan, the secondary colors of red, green and blue, and the third colors of yellow, magenta and cyan, and those which contained from 0% to 100% of the dot area factor of these colors were used.

After picture-making, the gloss unevenness, the color reproducibility and the offset phenomenon were evaluated. The gloss unevenness was evaluated visually after the image on the above charts was transferred and fixed on the transfer sheet. If gloss unevenness was hardly observed, it graded ○; if gloss unevenness was observed, it graded Δ, and if gloss unevenness was conspicuously observed, it graded ×.

The color reproducibility was evaluated by visual comparison of the original chart with the transfer sheet on which the image was transferred; if both were almost the same tint, it graded ○, if the difference of tints could be confirmed visually, it graded Δ, and if tints were different clearly, it graded ×.

Evaluation of the offset phenomenon was as follows: If no offset phenomenon was generated, it graded ○, if the image part was dimpled like a shell pattern, it graded Δ, and if the image part was peeled off, it graded ×.

The results of evaluation in Example 1 are shown in Table 1. As shown in Table 1, the sample in Example 1 showed no gloss unevenness, the gloss was even, the color reproducibility was excellent and the offset phenomenon did not occur.

TABLE 1

| | Ex. 1 | Ex. 2 | Ex. 3 | Ex. 4 |
|---|---|---|---|---|
| Characteristics of the transparent resin | | | | |
| Weight average molecular weight (Mwa) | 23,000 | 59,000 | 21,000 | 21,000 |
| Mwa/Mna | 5.9 | 15.0 | 5.9 | 4.9 |
| (Transparent resin, Mwa) - (Toner binding resin, Mwb) | 12,000 | 48,000 | 10,000 | 10,000 |
| (Transparent resin, Mwa/Mna) - (Toner binding resin, Mwb/Mnb) | 3.0 | 12.1 | 3.0 | 2.0 |
| Melt inclination angle with the toner binding resin (degree) | 30 | 37 | 40 | 33 |
| Coating weight of the transparent resin layer (g/m$^2$) | 5 | 7 | 5 | 5 |
| Results of evaluation | | | | |
| Gloss unevenness | ○ | ○ | ○ | ○ |
| Color reproducibility | ○ | ○ | ○ | ○ |
| Offset | ○ | ○ | ○ | ○ |

EXAMPLE 2

An electrophotographic transfer sheet was prepared. A polyester resin (ethylene oxide adduct of bisphenol A/propylene oxide adduct of bisphenol A/terephthalic acid/glycerol) having the weight average molecular weight of 59,000 and the ratio of the weight average molecular weight to the number average molecular weight of 15.0 determined by GPC was added to ethyl acetate in an amount of 20 wt % based on the ethyl acetate, alkyl phosphate surfactant was added thereto in an amount of 0.5 wt % based on the polyester resin as an antistatic agent, and the solution dissolved was coated by a bar coating method on the coat surface of a cast coated paper having a basis weight of 127.9 g/m$^2$ (a product of Oji Paper Co., Ltd.) so as to obtain the dry coat weight of the transparent resin layer of 7 g/m$^2$.

A full color fixed image was formed using the same toner and the color copier as used in Example 1, and evaluation was conducted. Further, the melt inclination angle with respect to the toner binding resin determined in the same method as in Example 1 was 37°.

The results of the evaluation are shown in Table 1. As shown in Table 1, the sample in this example showed no gloss unevenness, the gloss was even, the color reproducibility was excellent and the offset phenomenon did not occur.

EXAMPLE 3

An electrophotographic transfer sheet was prepared. A polyester resin (propylene oxide adduct of bisphenol A/fumaric acid) having the weight average molecular weight of 21,000 and the ratio of the weight average molecular weight to the number average molecular weight of 5.9 determined by GPC was added to ethyl acetate in an amount of 20 wt % based on the ethyl acetate, alkyl phosphate surfactant was added thereto in an amount of 0.5 wt % based on the polyester resin as an antistatic agent, and the solution dissolved was coated by a bar coating method on the coat surface of a cast coated paper having a basis weight of 127.9 g/m$^2$ (a product of Oji Paper Co., Ltd.) so as to obtain the dry coat weight of the transparent resin layer of 5 g/m$^2$.

A full color fixed image was formed using the same toner and the color copier as used in Example 1, and evaluation was conducted. Further, the melt inclination angle with respect to the toner binding resin determined in the same method as in Example 1 was 40°.

The results of the evaluation are shown in Table 1. As shown in Table 1, the sample in this example showed no gloss unevenness, the gloss was even, the color reproducibility was excellent and the offset phenomenon did not occur.

EXAMPLE 4

An electrophotographic transfer sheet was prepared. A polyester resin (propylene oxide adduct of bisphenol A/fumaric acid) having the weight average molecular weight of 21,000 and the ratio of the weight average molecular weight to the number average molecular weight of 4.9 determined by GPC was added to ethyl acetate in an amount of 20 wt % based on the ethyl acetate, alkyl phosphate surfactant was added thereto in an amount of 0.5 wt % based on the polyester resin as an antistatic agent, and the solution dissolved was coated by a bar coating method on the one side of art paper having a basis weight of 127.9 g/m$^2$ (a product of Oji Paper Co., Ltd.) so as to obtain the dry coat weight of the transparent resin layer of 5 g/m$^2$.

A full color fixed image was formed using the same toner and the color copier as used in Example 1, and evaluation was conducted. Further, the melt inclination angle with respect to the toner binding resin determined in the same method as in Example 1 was 33°.

The results of the evaluation are shown in Table 1. As shown in Table 1, the sample in this example showed no gloss unevenness, the gloss was even, the color reproducibility was excellent and the offset phenomenon did not occur.

COMPARATIVE EXAMPLE 1

An electrophotographic transfer sheet was prepared. A polyester resin (propylene oxide adduct of bisphenol A/fumaric acid) having the weight average molecular weight of 15,000 and the ratio of the weight average molecular weight to the number average molecular weight of 3.5 determined by GPC was added to ethyl acetate in an amount of 20 wt % based on the ethyl acetate, alkyl phosphate surfactant was added thereto in an amount of 0.5 wt % based on the polyester resin as an antistatic agent, and the solution dissolved was coated by a bar coating method on the coat surface of a cast coated paper having a basis weight of 127.9 g/m$^2$ (a product of Oji Paper Co., Ltd.) so as to obtain the dry coat weight of the transparent resin layer of 5 g/m$^2$.

A full color fixed image was formed using the same toner and the color copier as used in Example 1, and evaluation was conducted. Further, the melt inclination angle with respect to the toner binding resin determined in the same method as in Example 1 was 39°.

The results of the evaluation are shown in Table 2. As shown in Table 2, the sample in this comparative example showed no gloss unevenness, the gloss was even, and the color reproducibility was excellent but the image is partly peeled off and the offset phenomenon occurred.

TABLE 2

| | Comp. Ex. 1 | Comp. Ex. 2 | Comp. Ex. 3 | Comp. Ex. 4 | Comp. Ex. 5 |
|---|---|---|---|---|---|
| Characteristics of the transparent resin | | | | | |
| Weight average molecular weight (Mwa) | 15,000 | 20,000 | 21,000 | 55,000 | 73,000 |
| Mwa/Mna | 3.5 | 4.2 | 4.9 | 13.6 | 14.3 |
| (Transparent resin, Mwa) - (Toner binding resin, Mwb) | 4,000 | 9,000 | 10,000 | 44,000 | 62,000 |
| (Transparent resin, Mwa/Mna) - (Toner binding resin, Mwb/Mnb) | 0.6 | 1.3 | 2.0 | 10.7 | 11.4 |
| Melt inclination angle with the toner binding resin (degree) | 39 | 34 | 45 | 47 | 58 |
| Coating weight of the transparent resin layer (g/m$^2$) | 5 | 5 | 5 | 5 | 5 |
| Results of evaluation | | | | | |
| Gloss unevenness | ○ | ○ | Δ | Δ | × |
| Color reproducibility | ○ | ○ | × | Δ | ○ |
| Offset | × | Δ | ○ | ○ | ○ |

COMPARATIVE EXAMPLE 2

An electrophotographic transfer sheet was prepared. A polyester resin (propylene oxide adduct of bisphenol A/fumaric acid) having the weight average molecular weight of 15,000 and the ratio of the weight average molecular weight to the number average molecular weight of 4.2 determined by GPC was added to ethyl acetate in an amount of 20 wt % based on the ethyl acetate, alkyl phosphate surfactant was added thereto in an amount of 0.5 wt % based on the polyester resin as an antistatic agent, and the solution dissolved was coated by a bar coating method on the coat surface of a cast coated paper having a basis weight of 127.9 g/m$^2$ (a product of Oji Paper Co., Ltd.) so as to obtain the dry coat weight of the transparent resin layer of 5 g/m$^2$.

A full color fixed image was formed using the same toner and the color copier as used in Example 1, and evaluation was conducted. Further, the melt inclination angle with respect to the toner binding resin determined in the same method as in Example 1 was 34°.

The results of the evaluation are shown in Table 2. As shown in Table 2, the sample in this comparative example showed no gloss unevenness, the gloss was even, and the color reproducibility was excellent but the image was dimpled like a shell pattern.

COMPARATIVE EXAMPLE 3

An electrophotographic transfer sheet was prepared. A polyester resin (ethylene oxide adduct of bisphenol A/fumaric acid/isopropylene glycol) having the weight average molecular weight of 21,000 and the ratio of the weight average molecular weight to the number average molecular weight of 4.9 determined by GPC was added to ethyl acetate in an amount of 20 wt % based on the ethyl acetate, alkyl phosphate surfactant was added thereto in an amount of 0.5 wt % based on the polyester resin as an antistatic agent, and the solution dissolved was coated by a bar coating method on the coat surface of a cast coated paper having a basis weight of 127.9 g/m$^2$ (a product of Oji Paper Co., Ltd.) so as to obtain the dry coat weight of the transparent resin layer of 5 g/m$^2$.

A full color fixed image was formed using the same toner and the color copier as used in Example 1, and evaluation was conducted. Further, the melt inclination angle with respect to the toner binding resin determined in the same method as in Example 1 was 45°.

The results of the evaluation are shown in Table 2. As shown in Table 2, the sample in this comparative example showed the generation of gloss unevenness and the color reproducibility was bad but the offset phenomenon did not occur.

COMPARATIVE EXAMPLE 4

An electrophotographic transfer sheet was prepared. A polyester resin (propylene oxide adduct of bisphenol A/ethylene oxide adduct of bisphenol A/succinic acid/terephthalic acid/mellitic anhydride) having the weight average molecular weight of 55,000 and the ratio of the weight average molecular weight to the number average molecular weight of 13.6 determined by GPC was added to ethyl acetate in an amount of 20 wt % based on the ethyl acetate, alkyl phosphate surfactant was added thereto in an amount of 0.5 wt % based on the polyester resin as an antistatic agent, and the solution dissolved was coated by a bar coating method on the coat surface of a cast coated paper having a basis weight of 127.9 g/m$^2$ (a product of Oji Paper Co., Ltd.) so as to obtain the dry coat weight of the transparent resin layer of 5 g/m$^2$.

A full color fixed image was formed using the same toner and the color copier as used in Example 1, and evaluation was conducted. Further, the melt inclination angle with respect to the toner binding resin determined in the same method as in Example 1 was 47°.

The results of the evaluation are shown in Table 2. As shown in Table 2, the sample in this comparative example showed generation of gloss unevenness, the color reproducibility was not good and the color reproduced was different from the color in the original chart, but the offset phenomenon did not occur.

COMPARATIVE EXAMPLE 5

An electrophotographic transfer sheet was prepared. A polyester resin (propylene oxide adduct of bisphenol A/ethylene oxide adduct of bisphenol A/succinic acid/terephthalic acid/mellitic anhydride) having the weight average molecular weight of 73,000 and the ratio of the weight average molecular weight to the number average molecular weight of 14.3 determined by GPC was added to ethyl acetate in an amount of 20 wt % based on the ethyl acetate, alkyl phosphate surfactant was added thereto in an amount of 0.5 wt % based on the polyester resin as an antistatic agent, and the solution dissolved was coated by a bar coating method on the coat surface of a cast coated paper having a basis weight of 127.9 g/m$^2$ (a product of Oji Paper Co., Ltd.) so as to obtain the dry coat weight of the transparent resin layer of 5 g/m$^2$.

A full color fixed image was formed using the same toner and the color copier as used in Example 1, and evaluation was conducted. Further, the melt inclination angle with respect to the toner binding resin determined in the same method as in Example 1 was 58°.

The results of the evaluation are shown in Table 2. As shown in Table 2, the sample in this comparative example showed conspicuous gloss unevenness. The color reproducibility was excellent and the offset phenomenon did not occur.

By adopting the above constitution, the present invention can provide an electrophotographic transfer sheet which shows the even surface gloss of the image, excellent color reproducibility, and the tint of the developed color is the same with the color in the original chart, further, the offset phenomenon of the transparent resin layer does not occur, and the transfer sheet shows excellent running stability in a fixing apparatus.

While the invention has been described in detail and with reference to specific examples thereof, it will be apparent to one skilled in the art that various changes and modifications can be made therein without departing from the spirit and scope thereof.

What is claimed is:

1. A method for forming a color image which comprises the steps of:

developing using a color toner comprising a polyester binding resin to form a color toner image; and heat-fixing said color toner image onto an electrophotographic transfer sheet which comprises a substrate having, on at least one side thereof, a transparent resin layer comprising a polyester resin as a main component, wherein the weight average molecular weight (Mwa) of said transparent resin and the weight average molecular weight (Mwb) of a binding resin of a color toner used for fixing satisfy the relationship represented by the following equation:

$$Mwa-Mwb \geqq 10{,}000$$

and a melt inclination angle between said transparent resin and the binding resin of said color toner at the fixing temperature of the color toner is 40° or less.

2. A method for forming a color image which comprises the steps of:

developing using a color toner comprising a polyester binding resin to form a color toner image; and heat-fixing said color toner image onto an electrophotographic transfer sheet which comprises a substrate having, on at least one side thereof, a transparent resin layer comprising a polyester resin as a main component, wherein the ratio (Mwa/Mna) of the weight average molecular weight (Mwa) to the number average molecular weight (Mna) of said transparent resin and the ratio (Mwb/Mnb) of the weight average molecular weight (Mwb) to the number average molecular weight (Mnb) of a binding resin of a color toner to be fixed satisfy the relationship represented by the following equation:

$$(Mwa/Mna)-(Mwb/Mnb) \geqq 2.0$$

and a melt inclination angle between said transparent resin and the binding resin of said color toner at the fixing temperature of the color toner is 40° or less.

* * * * *